US008462102B2

(12) United States Patent
Wong et al.

(10) Patent No.: US 8,462,102 B2
(45) Date of Patent: Jun. 11, 2013

(54) DRIVING METHODS FOR BISTABLE DISPLAYS

(75) Inventors: Jialock Wong, San Leandro, CA (US); Yajuan Chen, Fremont, CA (US); Robert Sprague, Saratoga, CA (US); Hongmei Zang, Sunnyvale, CA (US)

(73) Assignee: SiPix Imaging, Inc., Fremont, CA (US)

( * ) Notice: Subject to any disclaimer, the term of this patent is extended or adjusted under 35 U.S.C. 154(b) by 1086 days.

(21) Appl. No.: 12/427,601

(22) Filed: Apr. 21, 2009

(65) Prior Publication Data

US 2009/0267970 A1 Oct. 29, 2009

Related U.S. Application Data

(60) Provisional application No. 61/047,908, filed on Apr. 25, 2008.

(51) Int. Cl.
*G09G 3/34* (2006.01)

(52) U.S. Cl.
USPC ..... 345/107; 359/296

(58) Field of Classification Search
USPC ..... 345/107, 204, 690; 359/296; 257/59
See application file for complete search history.

(56) References Cited

U.S. PATENT DOCUMENTS

| | | | |
|---|---|---|---|
| 3,612,758 | A | 10/1971 | Evans et al. |
| 4,143,947 | A | 3/1979 | Aftergut et al. |
| 4,443,108 | A | 4/1984 | Webster |
| 4,972,099 | A | 11/1990 | Amano et al. |
| 5,266,937 | A | 11/1993 | DiSanto et al. |
| 5,272,477 | A | 12/1993 | Tashima et al. |
| 5,754,584 | A | 5/1998 | Durrant et al. |
| 5,831,697 | A | 11/1998 | Evanicky et al. |
| 5,923,315 | A | 7/1999 | Ueda et al. |
| 5,930,026 | A | 7/1999 | Jacobson et al. |
| 5,961,804 | A | 10/1999 | Jacobson et al. |
| 6,005,890 | A | 12/1999 | Clow et al. |
| 6,019,284 | A | 2/2000 | Freeman et al. |
| 6,045,756 | A | 4/2000 | Carr et al. |
| 6,069,971 | A | 5/2000 | Kanno et al. |
| 6,111,248 | A | 8/2000 | Melendez et al. |
| 6,154,309 | A | 11/2000 | Otani et al. |
| 6,532,008 | B1 | 3/2003 | Guranlnick |
| 6,639,580 | B1 | 10/2003 | Kishi et al. |
| 6,657,612 | B2 | 12/2003 | Machida et al. |
| 6,671,081 | B2 | 12/2003 | Kawai |
| 6,674,561 | B2 | 1/2004 | Ohnishi et al. |
| 6,686,953 | B1 | 2/2004 | Holmes |
| 6,774,883 | B1 | 8/2004 | Muhlemann |
| 6,796,698 | B2 | 9/2004 | Sommers et al. |

(Continued)

FOREIGN PATENT DOCUMENTS

| | | |
|---|---|---|
| JP | 03282691 | 12/1991 |
| JP | 2000-336641 | 1/2002 |

(Continued)

OTHER PUBLICATIONS

U.S. Appl. No. 13/289,403, filed Nov. 4, 2011, Lin et al.

(Continued)

*Primary Examiner* — Abbas Abdulselam
(74) *Attorney, Agent, or Firm* — Perkins Coie LLP.

(57) ABSTRACT

The disclosure relates to driving methods for bistable displays, in particular, driving methods comprising interleaving driving waveforms.

11 Claims, 4 Drawing Sheets

U.S. PATENT DOCUMENTS

| | | | | |
|---|---|---|---|---|
| 6,885,495 | B2 | 4/2005 | Liang et al. | |
| 6,902,115 | B2 | 6/2005 | Graf et al. | |
| 6,903,716 | B2 | 6/2005 | Kawabe et al. | |
| 6,914,713 | B2 | 7/2005 | Chung et al. | |
| 6,930,818 | B1 | 8/2005 | Liang et al. | |
| 6,932,269 | B2 | 8/2005 | Sueyoshi et al. | |
| 6,950,220 | B2 | 9/2005 | Abramson et al. | |
| 6,995,550 | B2 | 2/2006 | Jacobson et al. | |
| 7,046,228 | B2 | 5/2006 | Liang et al. | |
| 7,177,066 | B2 | 2/2007 | Chung et al. | |
| 7,242,514 | B2 | 7/2007 | Chung et al. | |
| 7,283,119 | B2 | 10/2007 | Kishi | |
| 7,349,146 | B1 | 3/2008 | Douglass et al. | |
| 7,504,050 | B2 | 3/2009 | Weng et al. | |
| 7,626,444 | B2 | 12/2009 | Clewett et al. | |
| 7,733,311 | B2 | 6/2010 | Amundson et al. | |
| 7,800,580 | B2 | 9/2010 | Johnson et al. | |
| 7,839,381 | B2 | 11/2010 | Zhou et al. | |
| 7,999,787 | B2 * | 8/2011 | Amundson et al. | 345/108 |
| 8,035,611 | B2 | 10/2011 | Sakamoto | |
| 8,044,927 | B2 * | 10/2011 | Inoue | 345/107 |
| 2002/0021483 | A1 | 2/2002 | Katase | |
| 2002/0033792 | A1 | 3/2002 | Inoue | |
| 2003/0011868 | A1 | 1/2003 | Zehner et al. | |
| 2003/0035885 | A1 | 2/2003 | Zang et al. | |
| 2003/0067666 | A1 | 4/2003 | Kawai | |
| 2003/0095090 | A1 | 5/2003 | Ham | |
| 2003/0137521 | A1 | 7/2003 | Zehner et al. | |
| 2003/0227451 | A1 | 12/2003 | Chang | |
| 2004/0112966 | A1 | 6/2004 | Pangaud | |
| 2004/0120024 | A1 | 6/2004 | Chen et al. | |
| 2004/0219306 | A1 | 11/2004 | Wang et al. | |
| 2004/0246562 | A1 | 12/2004 | Chung et al. | |
| 2004/0263450 | A1 | 12/2004 | Lee et al. | |
| 2005/0001812 | A1 | 1/2005 | Amundson et al. | |
| 2005/0162377 | A1 | 7/2005 | Zhou et al. | |
| 2005/0163940 | A1 | 7/2005 | Liang et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0049263 | A1 | 3/2006 | Ou et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0209055 | A1 | 9/2006 | Wakita | |
| 2006/0238488 | A1 | 10/2006 | Nihei et al. | |
| 2006/0262147 | A1 | 11/2006 | Kimpe et al. | |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0091117 | A1 | 4/2007 | Zhou et al. | |
| 2007/0103427 | A1 | 5/2007 | Zhou et al. | |
| 2007/0109274 | A1 | 5/2007 | Reynolds | |
| 2007/0146306 | A1 | 6/2007 | Johnson et al. | |
| 2007/0159682 | A1 | 7/2007 | Tanaka et al. | |
| 2007/0182402 | A1 | 8/2007 | Kojima | |
| 2007/0188439 | A1 | 8/2007 | Kimura et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0211833 | A1 | 9/2008 | Inoue | |
| 2008/0303780 | A1 | 12/2008 | Sprague et al. | |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0283804 | A1 | 11/2010 | Sprague et al. | |
| 2010/0295880 | A1 | 11/2010 | Sprague et al. | |
| 2011/0096104 | A1 | 4/2011 | Sprague et al. | |
| 2011/0175945 | A1 | 7/2011 | Lin | |
| 2011/0216104 | A1 | 9/2011 | Chan et al. | |
| 2012/0120122 | A1 | 5/2012 | Lin et al. | |
| 2012/0274671 | A1 | 11/2012 | Sprague et al. | |

FOREIGN PATENT DOCUMENTS

| | | | |
|---|---|---|---|
| KR | 1020090129191 | A | 12/2009 |
| WO | WO 01/67170 | | 9/2001 |
| WO | WO 2005/004099 | | 1/2005 |
| WO | WO 2005004099 | A1 | 1/2005 |
| WO | WO 2005/031688 | | 4/2005 |
| WO | WO 2005/034076 | | 4/2005 |
| WO | WO 2005031688 | A1 | 4/2005 |
| WO | WO2005034076 | A1 | 4/2005 |
| WO | WO 2009/049204 | | 4/2009 |
| WO | WO 2010/132272 | | 11/2010 |

OTHER PUBLICATIONS

Allen, K. (Oct. 2003) Electrophoretics Fulfilled. *Emerging Displays Review: Emerging Display Technologies, Monthly Report*—Oct. 2003, pp. 9-14.

Bardsley, J. N. et al. (Nov. 2004) Microcup™ Electrophoretic Displays. *USDC Flexible Display Report*, 3.1:2, pp. 3.1.2-3.1.6.

Chaug, Y.S. et al. (Apr. 2004). Roll-to-Roll Processes for the Manufacturing of Patterned Conductive Electrodes on Flexible Substrates. *Mat. Res. Soc. Symp. Proc.* vol. 814, 19.6.1.

Chen, S.M. (Jul. 2003) The Applications for the Revolutionary Electronic Paper Technology. *OPTO News & Letters*, 102, 37-41. (in Chinese, English abstract).

Chen, S.M. (May 2003) The New Applications and the Dynamics of Companies. *TRI*. 1-10 (in Chinese, English abstract).

Chung, J. et al. (Dec. 2003). Microcup® Electrophoretic Displays, Grayscale and Color Rendition. *IDW*, AMD2/EP1-2, 243-246.

Ho, A. (Nov. 2006) *Embedding e-Paper in Smart Cards, Pricing Labels & Indicators*. Presentation conducted at Smart Paper Conference, Nov. 15-16, 2006, Atlanta, GA.

Ho, C. (Feb. 1, 2005) *Microcup® Electronic Paper Device and Application*. Presentation conducted at USDC 4th Annual Flexible Displays & Microelectronics Conference 2005 36 pages.

Ho, C. et al. (Dec. 2003) *Microcup® Electronic Paper by Roll-to-Roll Manufacturing Processes*. Presentation conducted at FEG, Nei-Li, Taiwan, 36 pages.

Hopper et al. (1979) An Electrophoretic Display, Its Properties, Model and Addressing. *IEEE Trans. Elect. Dev.*, ED 26, No. 8, pp. 1148-1152.

Hou, J. et al. (May 2004). Reliability and Performance of Flexible Electrophoretic Displays by Roll-to-Roll Manufacturing Processes. *SID Digest*, 32.3, 1066-1069.

Howard, R. (Feb. 2004) Better Displays with Organic Films. *Scientific American*, pp. 76-81.

Kishi et al., Development of In-plane EPD, SID 2000 Digest, pp. 24-27.

Lee, H. et al. (Jun. 2003) SiPix Microcup® Electronic Paper—An Introduction. *Advanced Display*, Issue 37, 4-9 (in Chinese, English abstract).

Liang, R. (Feb. 2003) *Microcup® Electrophoretic and Liquid Crystal Displays by Roll-to-Roll Manufacturing Processes*. Presentation conducted at the Flexible Microelectronics & Displays Conference of U.S. Display Consortium, Phoenix, Arizona, USA, 18 pages.

Liang, R. (Apr. 2004). *Microcup Electronic Paper by Roll-to-Roll Manufacturing Process*. Presentation at the Flexible Displays & Electronics 2004 of Intertech, San Francisco, California USA 26 pages.

Liang, R. (Oct. 2004) *Flexible and Roll-able Display/Electronic Paper—A Technology Overview*. Paper presented at the METS 2004 Conference in Taipei, Taiwan, 27 pages.

Liang, R. et al. (2003). Microcup® Active and Passive Matrix Electrophoretic Displays by a Roll-to-Roll Manufacturing Processes. *SID Digest*, 20.1, 4 pages.

Liang, R. et al. (Dec. 2002) Microcup Electrophoretic Displays by Roll-to-Roll Manufacturing Processes. *IDW*, EP2-2, 1337-1340.

Liang, R. et al. (Feb. 2003). *Passive Matrix Microcup® Electrophoretic Displays*. Paper presented at the IDMC, Taipei, Taiwan, 4 pages.
Liang, R. et al. (2003). Microcup® Displays: Electronic Paper by Roll-to-Roll Manufacturing Processes. *Journal of the SID*, 11(4), 621-628.
Liang, R. et al. (Jun./Jul. 2004) < Format Flexible Microcup® Electronic Paper by Roll-to-Roll Manufacturing Process >, Presentation conducted at the 14th FPD Manufacturing Technology EXPO & Conference, 44 pages (in Chinese, English abstract).
Liang, R. et al. (Feb. 2003). Microcup® LCD, *A New Type of Dispersed LCD by a Roll-to-Roll Manufacturing Process*. Paper presented at the IDMC, Taipei, Taiwan, 4 pages.
Liang, R. Nikkei Microdevices. (Dec. 2002) Newly-Developed Color Electronic Paper Promises—Unbeatable Production Efficiency. *Nikkei Microdevices*, 3. (in Japanese with English translation) 4 pages.
Swanson, et al., High Performance EPDs, SID 200 Digest, pp. 29-31.
Wang, X. et al. (Feb. 2004). Microcup® Electronic Paper and the Converting Processes. *ASID*, 10.1.2-26, 396-399, Nanjing, China.
Wang, X. et al. (Jun. 2004) Microcup® Electronic Paper and the Converting Processes. *Advanced Display*, Issue 43, 48-51.
Wang, X. et al. (Feb. 2006) *Inkjet Fabrication of Multi-Color Microcup® Electrophorectic Display*. The Flexible Microelectronics & Displays Conference of U.S. Display Consortium, 11 pages.
Wang, X. et al. (Jun. 2006) Roll-to-Roll Manufacturing Process for Full Color Electrophoretic Film. *SID Digest*, pp. 1587-1589.
Zang, H. (Feb. 2004). *Microcup Electronic Paper*. Presentation conducted at the Displays & Microelectronics Conference of U.S. Display Consortium, Phoenix, Arizona, USA, 14 pages.
Zang, H. (Oct. 2003). *Microcup® Electronic Paper by Roll-to-Roll Manufacturing Processes*. Presentation conducted at the Advisory Board Meeting, Bowling Green State University, Ohio, USA, 18 pages.
Zang, H. et al. (Feb. 2005) *Flexible Microcup® EPD by RTR Process*. Presentation conducted at 2nd Annual Paper-Like Displays Conference, Feb. 9-11, 2005, St. Pete Beach Florida 26 pages.
Zang, H. et al. (2003) Microcup Electronic Paper by Roll-to-Roll Manufacturing Processes. *The Spectrum*, 16(2), 16-21.
Zang, H. et al. (Jan. 2004). Threshold and Grayscale Stability of Microcup® Electronic Paper. *Proceeding of SPIE-IS&T Electronic Imaging, SPIE* vol. 5289, 102-108.
Zang, H. et al. (May 2006) Monochrome and Area Color Microcup® EPDs by Roll-to-Roll Manufacturing Processes. *ICIS '06 International Congress of Imaging Science Final Program and Proceedings*, pp. 362-365.
Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.
Kao, WC., (Feb. 2009) Configurable Timing Controller Design for Active Matrix Electrophoretic Dispaly. *IEEE Transactions on Consumer Electronics*, 2009, vol. 55, Issue 1, pp. 1-5.
Kao, WC., Ye, JA., and Lin, C. (Jan. 2009) Image Quality Improvement for Electrophoretic Displays by Combining Contrast Enhancement and Halftoning Techniques. *ICCE 2009 Digest of Technical Papers*, 11.2-2, 2 pgs.
Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2, 2 pgs.
Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers*, P4-3. (Int'l Conference on Consumer Electronics, Jan. 9-13, 2008), 2 pgs.
Korean Patent Office, "International Search Report & Written Opinion", dated Dec. 7, 2010, application No. PCT/US2010/033906, 9 pages.
Current Claims for Korean application No. PCT/US2010/033906, 1 page.
U.S. Appl. No. 12/046,197, filed Mar. 11, 2008, Wang et al.
U.S. Appl. No. 12/155,513, filed May 5, 2008, Sprague et al.
U.S. Appl. No. 13/004,763, filed Jan. 11, 2011, Lin et al.
U.S. Appl. No. 13/152,140, filed Jun. 2, 2011, Lin.
Sprague, R.A. "Active Matrix Displays for e-Readers Using Microcup Electrophoretics". Presentation conducted at SID 2011, 49 International Symposium Seminar and Exhibition, dated May 18, 2011, 20 pages.

* cited by examiner

DRIVING METHODS FOR BISTABLE DISPLAYS

BENEFIT CLAIM

The present application claims the benefit under 35 U.S.C. 119(e) of prior provisional application 61/047,908, filed Apr. 25, 2008, the entire contents of which is hereby incorporated by reference for all purposes as if fully set forth herein.

FIELD OF THE DISCLOSURE

The present disclosure relates to driving methods for bistable displays such as electrophoretic displays.

BACKGROUND

The electrophoretic display (EPD) is a non-emissive device based on the electrophoresis phenomenon of charged pigment particles suspended in a solvent. The display usually comprises two plates with electrodes placed opposing each other, separated by spacers. One of the electrodes is usually transparent. A suspension composed of a colored solvent and charged pigment particles is enclosed between the two plates. When a voltage difference is imposed between the two electrodes, the pigment particles migrate to one side or the other, according to the polarity of the voltage difference. As a result, either the color of the pigment particles or the color of the solvent is seen from the viewing side. Alternatively, the suspension may comprise a clear solvent and two types of colored particles which migrate to opposite sides of the device when a voltage is applied. Further alternatively, the suspension may comprise a dyed solvent and two types of colored particles which alternate to different sides of the device. In addition, in-plane switching structures have been shown where the particles may migrate in a planar direction to produce different color options.

There are several different types of EPDs, such as the conventional type EPD, the microcapsule-based EPD or the EPD with electrophoretic cells that are formed from parallel line reservoirs. EPDs comprising closed cells formed from microcups filled with an electrophoretic fluid and sealed with a polymeric sealing layer is disclosed in U.S. Pat. No. 6,930,818, the entire contents of which are hereby incorporated by reference as if fully set forth herein.

Currently available driving methods for electrophoretic displays have certain disadvantages. For example, they are incapable of providing fast response for input actuation. As a result, the methods often render the electrophoretic displays not useful for applications which require instant feedback, such as input-enabled devices. In addition, black and white flashes which are often used between images may be considered annoying by the user.

SUMMARY OF THE DISCLOSURE

In an embodiment, the disclosure provides driving methods which are particularly suitable for bistable displays. In an embodiment, methods can achieve fast optical response and also enable interruptions when a display device is in use.

In a first embodiment, a driving method is provided for driving a first group of pixels from a first color state to a second color state and a second group of pixels from the second color state to the first color state, which method comprises applying interleaving uni-polar driving waveforms.

In a second embodiment, a driving method is provided for driving a first group of pixels from a first color state to a second color state and a second group of pixels from the second color state to the first color, which method comprises applying interleaving uni-polar driving waveforms and waveforms for improving visual appearance during transition of the images displayed.

In a third embodiment, a driving method is provided for driving a first group of pixels from a first color state to a second color state and a second group of pixels from the second color state to the first color state, which method comprises applying interleaving uni-polar driving waveforms and waveforms for improving visual appearance during transition of the images displayed, wherein the average voltage applied across the display is substantially zero when integrated over a time period and thereby provides global DC balance.

In a fourth embodiment, a driving method is provided for driving a first group of pixels from a first color state to a second color state and a second group of pixels from the second color state to the first color state, which method comprises applying interleaving uni-polar driving waveforms, wherein the average voltage applied across the display is substantially zero when integrated over a time period and thereby provides global DC balance.

In a fifth embodiment, a driving method is provided that comprises interrupting the driving sequence for one image before it is completed in order to more rapidly change to a new image. The driving method may further comprise applying interleaving waveforms. Previously used waveforms for driving an electrophoretic display are not easily interrupted because interruptions may impact the DC balance (for good image quality) of the waveforms and thus produce image artifacts such as residual images.

In a sixth embodiment, any of the driving methods described above are used for a display device, and the method further comprises applying refreshing driving waveforms when the display device is not in use.

The driving methods of the present disclosure can be applied to drive electrophoretic displays including, but not limited to, one time applications or multiple display images. They may also be used for any display devices which require fast optical response and interruption of display images.

The whole content of each of the other documents referred to in this application is also incorporated by reference into this application in its entirety for all purposes as if fully set forth herein.

DETAILED DESCRIPTION

Figure 1:
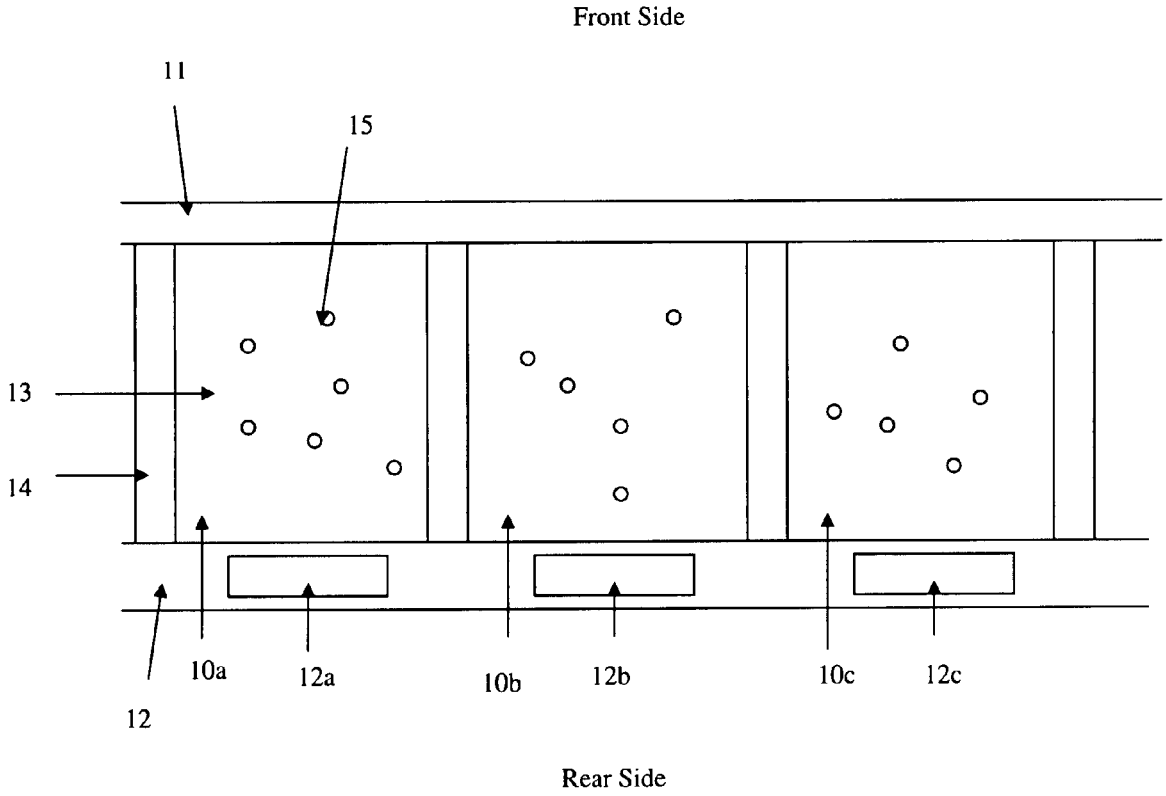
FIG. 1 is a cross-section view of an example display device.

FIG. 1 illustrates an array of display cells (10*a*, 10*b* and 10*c*) in an electrophoretic display which may be driven by the driving methods of the present disclosure. In FIG. 1, the display cells are provided, on its front (or viewing) side (top surface as illustrated in FIG. 1) with a common electrode (11) (which usually is transparent) and on its rear side with a substrate (12) carrying a set of discrete pixel electrodes (12*a*, 12*b* and 12*c*). Each of the discrete pixel electrodes (12*a*, 12*b* and 12*c*) defines a pixel of the display. An electrophoretic fluid (13) is filled in each of the display cells. For ease of illustration, FIG. 1 shows only a single display cell associated with a discrete pixel electrode, although in practice a plurality of display cells (as a pixel) may be associated with one discrete pixel electrode. The electrodes may be segmented in nature rather than pixellated, defining regions of the image instead of individual pixels. Therefore while the term "pixel" or "pixels" is frequently used in the application to illustrate the driving methods herein, it is understood that the driving methods are applicable to not only pixellated display devices, but also segmented display devices.

Each of the display cells is surrounded by display cell walls (14). For ease of illustration of the methods described below, the electrophoretic fluid is assumed to comprise white charged pigment particles (15) dispersed in a dark color solvent and the particles (15) are positively charged so that they will be drawn to the discrete pixel electrode or the common electrode, whichever is at a lower potential.

The term "display cell" refers to a micro-container which is individually filled with a display fluid. The term includes, but is not limited to, microcups, microcapsules, microchannels, conventional partition type display cells and equivalents thereof. This disclosure is intended to broadly encompass cover all types of display cells.

The driving methods herein also may be applied to particles (15) in an electrophoretic fluid which are negatively charged. Also, the particles could be dark in color and the solvent light in color so long as sufficient color contrast occurs as the particles move between the front and rear sides of the display cell. The display could also be made with a transparent or lightly colored solvent with particles of two different colors and carrying opposite charges.

The display cells may be the conventional partition type of display cells, the microcapsule-based display cells or the microcup-based display cells. In the microcup-based display cells, the filled display cells may be sealed with a sealing layer (not shown in FIG. 1). There may also be an adhesive layer (not shown) between the display cells and the common electrode. The display of FIG. 1 may further comprise color filters.

The display device of FIG. 1 may be viewed from the front side or the rear side. In the latter case, the substrate 12 and the pixel electrodes 12*a*, 12*b* and 12*c*, of course, are transparent.

The common electrode and the pixel electrodes are separately connected to two individual circuits and the two circuits in turn are connected to a display controller. In practice, the display controller issues signals to the circuits to apply appropriate voltages to the common and pixel electrodes respectively. More specifically, the display controller, based on the images to be displayed, selects appropriate waveforms and then issues signals, frame by frame, to the circuits to execute the waveforms by applying appropriate voltages to the common and pixel electrodes. The term "frame" represents timing resolution of a waveform.

The pixel electrodes may be TFTs (thin film transistors) which are deposited on substrates such as flexible substrates.

Figure 2:
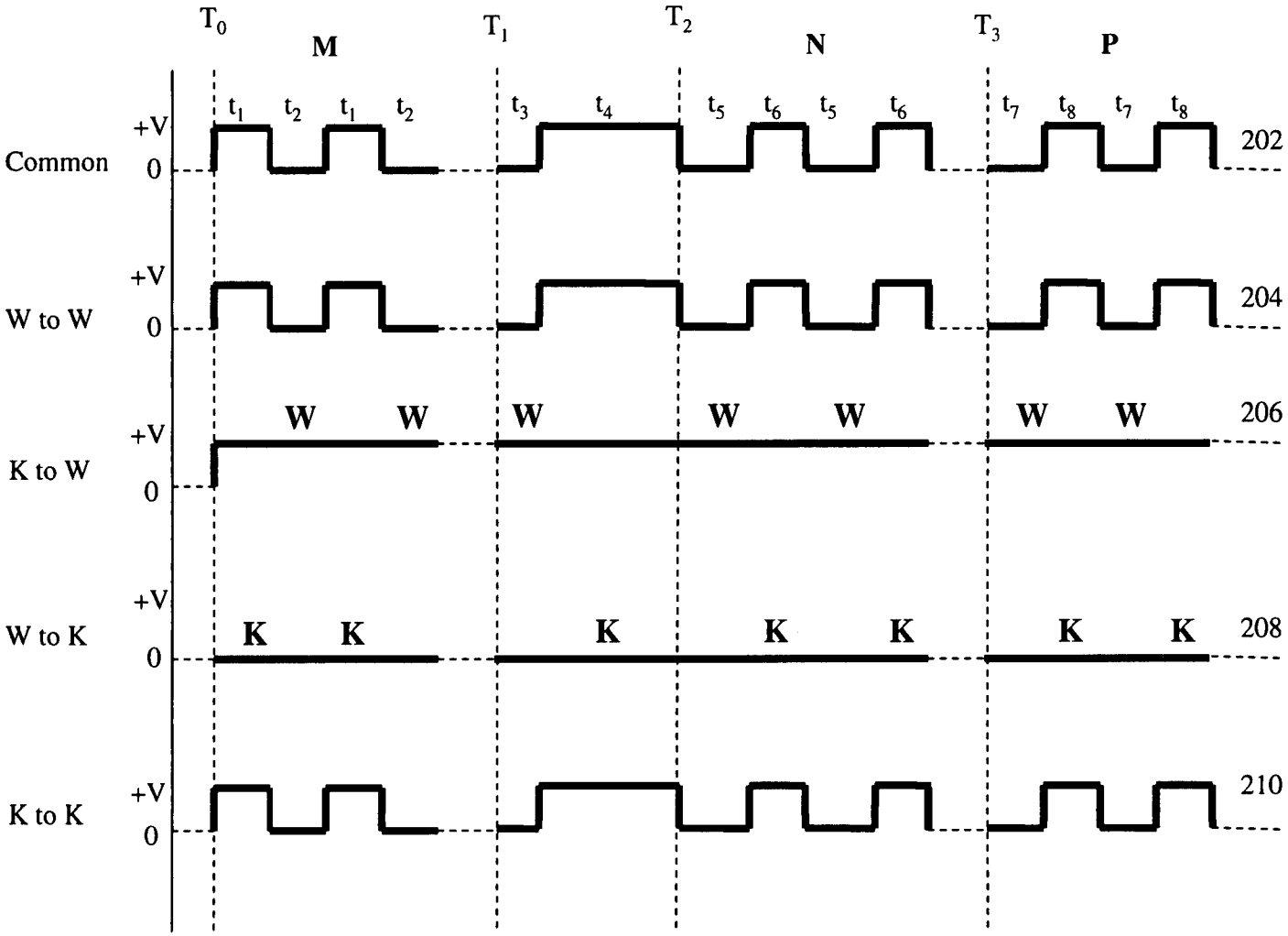
FIG. 2 illustrates example driving waveforms.

FIG. 2 illustrates example driving waveforms. FIG. 2 illustrates a uni-polar driving method. The driving method shown in the figure comprises a soft driving phase (from times $T_0$-$T_3$) and a full driving phase (from time $T_3$ to the start of next driving phase).

The top waveform 202 represents the voltages applied to the common electrode in a display device. The four waveforms 204, 206, 208, 210 below waveform 202 represent how pixels in the display device may be driven from "white to white (W to W)", "black to white (K to W)", "white to black (W to K)" and "black to black (K to K)", respectively, as indicated by corresponding labels in FIG. 2. The initial color, white or black, of a pixel is the color of the pixel before the driving method is applied.

In the driving frame between $T_0$ and $T_1$, there is a driving cycle which consists of $t_1$ and $t_2$. As shown in the figure, the driving cycle of $t_1$ and $t_2$ is applied twice. However in practice, such a cycle may be applied three (i.e., M=3) or more times.

In the driving frame between $T_1$ and $T_2$, there is a driving cycle which consists of $t_3$ and $t_4$. This driving cycle, in this example, is applied only once.

In the driving frame between $T_2$ and $T_3$, there is a driving cycle which consists of $t_5$ and $t_6$. This driving cycle is shown to be applied only twice in the figure; but in practice it may be applied four times (i.e., N=4).

The time point $T_3$ designates the end of the soft driving phase or the beginning of the full driving phase.

In the full driving phase, there is a driving cycle which consists of $t_7$ and $t_8$. This driving cycle, in practice, may be applied eight times (i.e., P=8).

Table 1 below provides more specifics for the driving waveform example of FIG. 2.

TABLE 1

| | |
|---|---|
| $t_1$ | 35 msec |
| $t_2$ | 35 msec |
| M | 3 repetitions |
| $t_3$ | 25 msec |
| $t_4$ | 65 msec |
| $t_5$ | 50 msec |
| $t_6$ | 40 msec |
| N | 4 repetitions |
| Total Soft Drive | 660 msec |
| $t_7$ | 35 msec |
| $t_8$ | 35 msec |
| P | 8 repetitions |
| Total Full Drive | 560 msec |

A first embodiment is directed to a driving method for driving a first group of pixels from a first color state to a second color state and a second group of pixels from the second color state to the first color state, which method comprises applying interleaving uni-polar driving waveforms.

The interleaving waveforms are illustrated for cases in which pixels are driven from the black (K) state to the white (W) state and the pixels being driven from the white (W) to the black (K) state. As shown in FIG. 2, a driving pulse (i.e., a potential difference between the common electrode and the pixel electrode) is applied to the pixels changing from the black to the white state and the pixels changing from the white to the black state, in an alternating fashion. The letters in bold indicate that a driving pulse has been applied to those pixels. For example, in the first $t_1$ period, no net voltage is applied to the "K to W" pixels as indicated by a difference in the waveforms 202, 206 at that period, whereas a −V voltage is applied to the "W to K" pixels as indicated by waveforms 202, 208 and in the first $t_2$ period after the first $t_1$ period, a +V voltage is applied to the "K to W" pixels wherein no voltage is applied to the "W to K" pixels. Since the display medium takes a number of pulses to respond, the interleaving waveforms allow smooth transitions between images, thus providing visually pleasant images to the viewer.

Interleaving driving waveforms are known as applying driving pulses to pixels being driven from a first color state to a second color state and pixels being driven from the second color state to the first color state, in an alternating fashion.

A second embodiment is directed to a driving method for driving a first group of pixels from a first color state to a second color state and a second group of pixels from the second color state to the first color, which method comprises applying interleaving uni-polar driving waveforms and waveforms for improving visual appearance during transition of the images displayed. The driving cycle of $t_3$ and $t_4$ in the example of FIG. 2 represents waveforms which may improve the visual appearance of the images displayed. The driving cycle of $t_3$ and $t_4$ is optional. When it is present, it applies a driving pulse to the "W to K" pixels which is longer in duration than the driving pulse to the "K to W" pixels. As a result, it provides a better visual appearance during transition of the images displayed.

A third embodiment is directed to a driving method for driving a first group of pixels from a first color state to a second color state and a second group of pixels from the second color state to the first color state, which method comprises applying interleaving uni-polar driving waveforms and waveforms for improving visual appearance during transition of the images displayed, wherein the average voltage applied across the display is substantially zero when integrated over a time period, thereby providing global DC balance. The global DC balance feature is also demonstrated by the driving method of FIG. 2. It is first noted that the driving voltages, when applied, are the same in intensity. While $t_4$ is longer than $t_3$ by 40 msec, this difference is compensated by the fact that $t_5$ is longer than $t_6$ by 10 msec and the driving cycle of $t_5$ and $t_6$ is applied four times. As a result, the average voltage applied across the display device is substantially zero when integrated over a time period.

A fourth embodiment is directed to a driving method for driving a first group of pixels from a first color state to a second color state and a second group of pixels from the second color state to the first color state, which method comprises applying interleaving uni-polar driving waveforms, wherein the average voltage applied across the display is substantially zero when integrated over a time period. As stated above, the driving cycle of $t_3$ and $t_4$ is optional. When this driving cycle is absent, the pulse durations may be easily adjusted to provide global DC balance.

A fifth embodiment is directed to a driving method comprising a soft drive phase, a full drive phase and interrupting driving signals, which driving method comprises applying said interrupting driving signals between the soft drive phase and the full drive phase or during the full drive phase. In other words, the interruptions may occur while the display device is in use. A requirement for such interruptions is anticipated in devices which utilize user interactions, since the user may desire to move to a new display image before the previous one is completely formed. More specifically, the interruptions may occur after the end of the soft drive phase and before the beginning the full drive phase. Alternatively, the interruptions may occur after each of the driving cycles consisting of $t_7$ and $t_8$. For example, an interruption may occur after the first driving cycle of $t_7$ and $t_8$ or after the second driving cycle of $t_7$ and $t_8$, etc. Alternatively, an interruption may occur at any time during any phase of the driving signal, but this may introduce a DC imbalance which will result in requiring additional DC balance.

Figure 3:
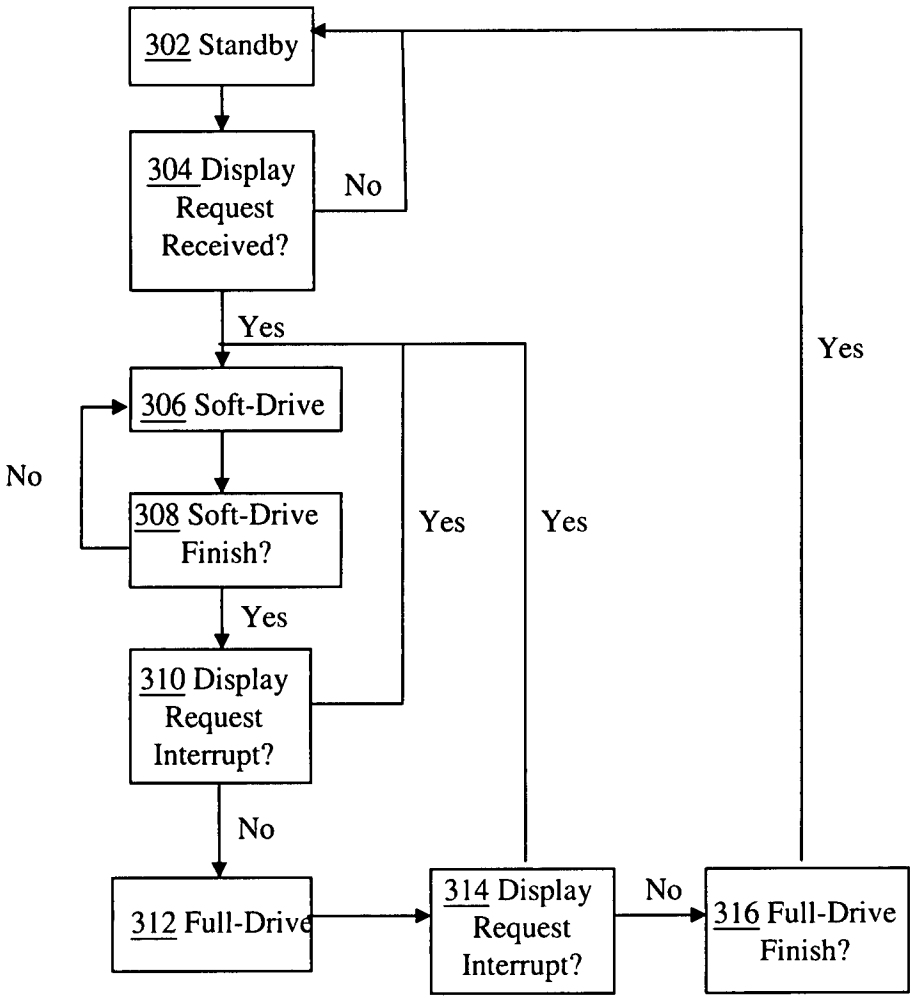
FIG. 3 illustrates a driving method with interruptions.

FIG. 3 illustrates a driving method with interruptions. At step 302 a display device is in standby state. At step 304 a test is performed to determine whether a request to display data has been received. If not, then control loops to step 302. Otherwise, as shown, the driving method begins with a soft-drive phase at 306. After the soft-drive phase 306 is finished at 308, the driving method may be interrupted at 310 before the full-drive phase 312 begins. For brevity, during the full-drive phase 312, the driving method is shown to have only one possibility of interruption. However, as stated above, during the full-drive phase 312, the driving method may be interrupted after each of the driving cycles as seen at step 314; if no interruption occurs then the full-drive phase 312 finishes at step 316 and control loops to step 302 to resume the standby state.

A sixth embodiment provides the application of an interleaving waveform to a display device capable of displaying grey scale images. The foregoing discussion assumes the display is a binary system having only two display states. In practice, for a grey scale display device, the same interruption and DC balance features described above may be applied to achieve different grey levels by varying the length of the interleaving waveform pulses and/or by shortening the length of the pulse train for certain pixels so that they are only turned on partially. The advantages of the interleaving waveform and DC balance discussed above for the binary system are also applicable to method and circuits used for grey scale display devices.

A seventh embodiment is directed to any of the driving methods described above for a display device, further comprising applying refreshing driving waveforms when the display device is not in use.

Figure 4:
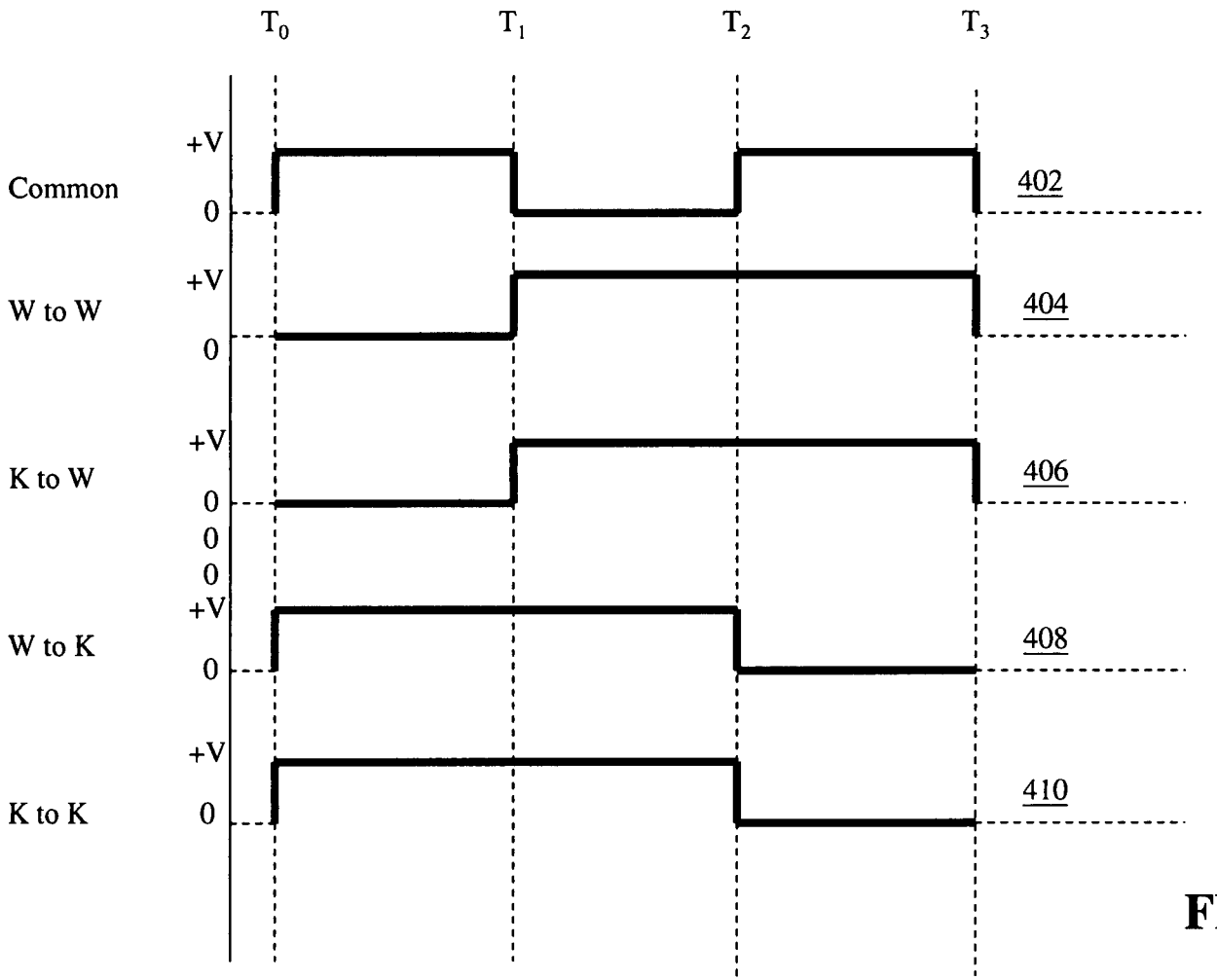
FIG. 4 illustrates an example of refreshing driving waveforms applicable to any of the driving methods of the present disclosure.

An example of refreshing driving waveforms is shown in FIG. 4. Top waveform 402 represents voltages applied at a common electrode and the other waveforms 404, 406, 408, 410 are for driving pixel electrodes of pixels that are driven from a white state to a colored state, using the same notation as in FIG. 2. Such refreshing waveforms 404, 406, 408, 410 may be applied to a display device at any time when the display device is not in use. They may be pre-programmed to be activated at a desirable time. As shown, the refreshing waveforms are global DC balanced. In addition, the refreshing waveforms as shown are also total DC balanced which means that the average voltage applied across each of the pixels is substantially zero when integrated over a time period.

The purpose of the refreshing waveforms is to refresh the charged pigment particles in the display fluid, thus allowing the display device to maintain its bistability.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the improved driving scheme for an electrophoretic display, and for many other types of displays including, but not limited to, liquid crystal, rotating ball, dielectrophoretic and electrowetting types of displays. Accordingly, the present embodiments are to be considered as illustrative and not restrictive, and the invention is not to be limited to the details given herein, but may be modified within the scope and equivalents of the appended claims.

What is claimed is:

1. A method implemented in an electrophoretic display device which has a color system of a first color state and a second color state, comprising:

a display device applying, to each pixel of a first group of pixels that are in the first color state, a first positive voltage at a common electrode and a first no voltage at each of pixel electrodes coupled to pixels of the first group, during a first time period to drive the pixels of the first color state to the second color state;

the display device applying, to each pixel of a second group of pixels that are in the second color state, a second no voltage at the common electrode and a second positive voltage at each of pixel electrodes coupled to pixels of the second group, during a second time period after the first time period to drive the pixels of the second color state to the first color state.

2. The method of claim 1 further comprising the display device applying visual appearance improvement waveforms during a transition of the first group of pixels from the first color state to the second color state and of the second group of pixels from the second color state to the first color state.

3. The method of claim 2 wherein an average voltage applied across the display device when integrated over a third time period that includes the first time period and the second time period, is substantially zero.

4. The method of claim 1 comprising a soft drive phase, a full drive phase and interrupting driving signals, and the display device applying said interrupting driving signals between the soft drive phase and the full drive phase or during the full drive phase.

5. The method of claim 4 wherein the display device applies the interrupting driving signals during the full drive phase after a driving cycle comprising at least the first time period and the second time period.

6. The method of claim 1, wherein the display device applies a first alternating voltage waveform to the common electrode wherein the first positive voltage and the second no voltage alternate at the first time period and the second time period.

7. The method of claim 6, further comprising the display device applying a second alternating voltage waveform to pixel electrodes coupled to a third group of pixels that are in the first color state and pixel electrodes coupled to a fourth group of pixels that are in the second color state wherein the second alternating voltage waveform has a same cycle and same voltages as the first alternating voltage waveform.

8. The method of claim 7, further comprising the display device applying the first no voltage continuously at the pixel electrodes of the first group of pixels during the first alternating voltage waveform.

9. The method of claim 8, further comprising the display device applying the second positive voltage continuously at the pixel electrodes of the second group of pixels during the first alternating voltage waveform.

10. The method of claim 1, wherein the first color state and the second color state are a black color state and a white color state, or vice versa.

11. The method of claim 1, wherein the first time period and the second time period are equal.

* * * * *